US005281113A

United States Patent [19]

Simnovec

[11] Patent Number: 5,281,113

[45] Date of Patent: Jan. 25, 1994

[54] THICK MATERIALS PUMP WITH PAIRED, PREFERABLY PARALLEL FEED CYLINDERS WHICH ALTERNATINGLY DELIVER AND INTAKE

[75] Inventor: Andrej Simnovec, Recklinghausen, Fed. Rep. of Germany

[73] Assignee: Friedrich Wilh, Schwing GmbH, Fed. Rep. of Germany

[21] Appl. No.: 14,059

[22] Filed: Feb. 5, 1993

Related U.S. Application Data

[63] Continuation of Ser. No. 787,903, Nov. 6, 1991, abandoned.

[30] Foreign Application Priority Data

Nov. 16, 1990 [DE] Fed. Rep. of Germany ..... 4036623
Jan. 30, 1991 [DE] Fed. Rep. of Germany ..... 4102682

[51] Int. Cl.[5] ..... F04B 7/00

[52] U.S. Cl. ..... 417/519; 417/900; 137/625.43

[58] Field of Search ..... 417/516, 517, 518, 519 O, 417/900 X, 531, 532; 137/625.43 X, 625.47

[56] References Cited

U.S. PATENT DOCUMENTS

| | | | |
|---|---|---|---|
| 1,413,165 | 4/1922 | Keith | 417/532 |
| 3,192,914 | 7/1965 | Kopczyk | 417/519 |
| 3,741,691 | 6/1973 | Schwing | 417/519 |

*Primary Examiner*—Richard A. Bertsch
*Assistant Examiner*—Alfred Basichas
*Attorney, Agent, or Firm*—Kinney & Lange

[57] ABSTRACT

In a thick materials pump with paired, preferably parallel, feed cylinders, which alternatingly deliver and intake, and with a slide, which pivots on the axis of a central channel and, for each pair of feed cylinders, connects, by way of a branch channel, the given feed cylinder with a fixed feed conduit connecting to the central channel, while, simultaneously and by means of a sealing control surface provided on the inner wall of the slide housing for each branch channel receiving the thick material and provided with an aperture for each branch channel, closing a second branch channel of the slide and freeing the intake feed cylinder, while identical pressures are developed in the branch channels of equal length, the invention is characterized by the facts that the branch channels (7, 8) are essentially aligned and, in each case, form a right angle with the central channel (9), and that the sealing control surfaces (18, 20) on the slide housing (21) are cylindrically arched.

6 Claims, 4 Drawing Sheets

THICK MATERIALS PUMP WITH PAIRED, PREFERABLY PARALLEL FEED CYLINDERS WHICH ALTERNATINGLY DELIVER AND INTAKE

This is a continuation of application Ser. No. 07/787,903 filed on Nov. 6, 1991, abandoned as of the date of this application.

BACKGROUND OF THE INVENTION

The invention pertains to a thick materials pump in keeping with the preamble of claim 1.

The thick materials to be conveyed by the pump of the invention can be of varied composition, while, as a general rule, the given thick material being conveyed represents a mixture of different materials. Generally, these are mushy masses with a more or less great proportion of water, e.g., sewage sludges, mortars, or the like. In particular, the invention pertains to pumps for concrete, by means of which the liquefied mixture consisting essentially of sand, cement, additives, and water must be pumped over relatively great distances and differences in height.

The thick materials pump of the invention operates with feed cylinders, in which the pistons move back and forth and, during the backward stroke, load the cylinder with the thick material usually drawn in through the slide housing from a filling container, while, during the forward stroke, the slide forces the thick material into a feed conduit affixed to the frame. In keeping with the invention, two feed cylinders always work in tandem in such a way that one of the cylinders is being filled while the other is being emptied into the feed conduit, so that the intake and delivery strokes of the two pistons overlap. Accordingly, the invention can be adapted to more than a single pair of cylinders when a temporally closer overlapping of the feed strokes is desired.

Regulation of the feed and intake flow is accomplished by the slide, which has a branch channel for each feed cylinder, which, during the feed stroke, communicatively connects the cylinder with a central channel leading to the feed conduit, while the slide simultaneously frees the aperture of the cylinder with the intake piston, so that the incoming thick material flows past the slide and into said cylinder. As a general rule, when the thick materials pump has more than one pair of feed cylinders, additional branch channels must be provided for each added feed cylinder. The invention is described in greater detail below in terms of its preferred embodiment form, which is designed as a two-cylinder pump for thick materials.

It must be initially pointed out, however, that in all embodiments of the thick materials pump of the invention the openings of the branch channels in the slide, which communicate with their respective cylinders, must seal against the wall of a slide housing, so that, on the one hand, the flow of thick material under the pressure of the feed piston does not completely or even partially spill into the intake cylinder during its filling with thick material, and on the other hand, the thick material cannot flow back into the filling container during the intake. Consequently, a certain sequence of the movements of the slide must be synchronized with the movements of the pistons in the cylinders, which is also a part of the invention, just as is the possibility, in the case of many thick materials pumps of this type, of feeding the thick material from the feed conduit into the slide housing communicating with the filling container by reversing the sequence.

These general features described above characterize thick materials pumps, which are generally expected to be capable, with simple construction and despite their complicated method of operation and their stresses during the feed operation, especially over great delivery distances and heights, of operating without excessive disruption due to wear or failure of functionally essential components and, particularly, of providing continuous feeding of the thick materials to the maximum extent possible. This problem is fundamental to the invention.

A pump for thick materials of the type described in the introduction is known (German Patent (OLS) No. 2,721,678), which has a slide in the form of a V-shaped, bifurcated pipe, in which the branch channels from the tines of a fork and the longitudinal axis of the central tube is the geometrical axis, on which the slide pivots when the pump is in operation. The forked tube is then formed by the separation of the parallel or aligned feed cylinders in the embodiment form of a two-cylinder pump for thick materials. The bifurcated design of the slide is also suitable for four-cylinder pumps for thick materials, while the pairs of feed cylinders must then be aligned and two cylinders must act simultaneously as delivery cylinders. Regardless of the number of feed cylinders, the free ends of the branch channels are curved, while, in the embodiment as a two-cylinder pump for thick materials, one opening of one of the two cylinders always closes against one of the two sealing control surfaces, while the other provides the connection with the feed cylinder. Accordingly, these sealing control surfaces are flat and therefor located at the base of a filling container.

The stresses on the slide are disproportionately great during operation and intensify with increasing feed length and height. This is due to the reaction forces developed in the slide during the feeding of the thick material. With each stroke of a feed piston the two openings of the branch channels are subjected to the feed pressure. From the feed pressure and the areas of the interior cross section of the branch channels, reaction forces develop in both branch channels, which cause the slide to lift away from the sealing control surface and the aperture of the feed cylinder. It is true that these forces are partially compensated by forces developed from the interior cross-sectional area of the central channel and the feed-channel pressure. This is the force that must be overcome by the feeding. Consequently, there remains considerably residual force, which produces a rift at the openings of the branch channels, which cannot be tolerated if the aforementioned short circuiting of the feed flows is to be avoided. This dictates disproportionately heavy bearings for the pivoting slide and the shaft powering the slide. Nevertheless, premature wear of these essential components cannot be ruled out.

The fundamental objective of the invention is avoidance of these shortcomings and attainment of results, which favorably affect the problem cited in the introduction.

SUMMARY OF THE INVENTION

This objective is realized by way of the characteristics of claim 1. Additional characteristics of the invention are the subjects of the subordinate claims.

In keeping with the invention as described in claim 1, the alignment of the branch channels ensures that their openings practically overlap in their vertical projection. As a result, the principal part of the reaction forces is mutually compensated. There remains only one reaction force derived from the absent overlapping on a partial area. This can develop, if the cylinder apertures are drawn closer together, which is advantageous because of the space requirement but disrupts the compensation of the reaction forces only insignificantly.

Due to the alignment of the branch channels and as a result of the identical length of the two component channels, there is central symmetry of the slide in the longitudinal plane of the central channel, which, with the pivoting movement of the slide, permits the cylindrical form of the sealing control surfaces. Then, the branch channels can be designed with straight ends, which is favorable from the point of view of fluid mechanics and also permits simplification of the seal, since the rift between the opening of the branch channel and its corresponding sealing control surface, or that in the aperture, does not change during the pivoting movement.

The invention has the distinct advantage that it permits a heretofore unattainable light construction by eliminating the heavy bearings of the slide and its drive shaft in the housing, as well as a dependable and less disruption-prone seal of the slide in the slide housing. Consequently, thick materials pumps in keeping with the invention can be supplied in smaller form and at low cost and can also be utilized at small construction sites with appreciable gain in the rationalization of the conveying of thick materials.

In a preferential embodiment of the invention, which is reflected in claim 2, the branch channels are exactly aligned and, therefore, the slide is designed to be free of reaction forces. This results in the exact T-shape of the channels in the slide.

With the characteristics set forth in claim 3, the cylindrical form of the sealing control surfaces is expanded to the form of the entire slide housing. This results in a centrally symmetrical form of the housing, which is favorable from the point of view of fabrication. In operation, this design has an additional advantage. With the known slides having the tubular form typifying this embodiment of the invention, a trailing wave is formed behind each branch pipe in the course of the pivoting movements due to the tenacity of the thick material, while such is not the case with the embodiment type described in claim 3, since the free housing space in front of and behind each branch pipe remains the same and accordingly agrees exactly with the quantity of thick material being displaced in the advancing branch pipe. As a result, no trailing wave is formed in the slide housing and no depression in the thick material ensues. Such depressions must, in fact, first be overcome by the feed piston inside the feed cylinder before the feed flow can begin. This leads to irregular feeding and is, therefore, unfavorable. This disadvantage is avoided by the invention.

On the other hand, the invention can be realized with the characteristics of claim 4, so that no thick material need be displaced within the slide housing. The form of the slide is then fully cylindrical, which, because of the effects of the invention, can be realized without appreciable added weight of the slide.

BRIEF DESCRIPTION OF THE DRAWINGS

Details, additional characteristics, and other advantages of the invention are set forth in the following description of several embodiment forms of the invention with references to the appended drawings; these depict.

DETAILED DESCRIPTION OF THE PREFERRED EMBODIMENTS

Figure 1:
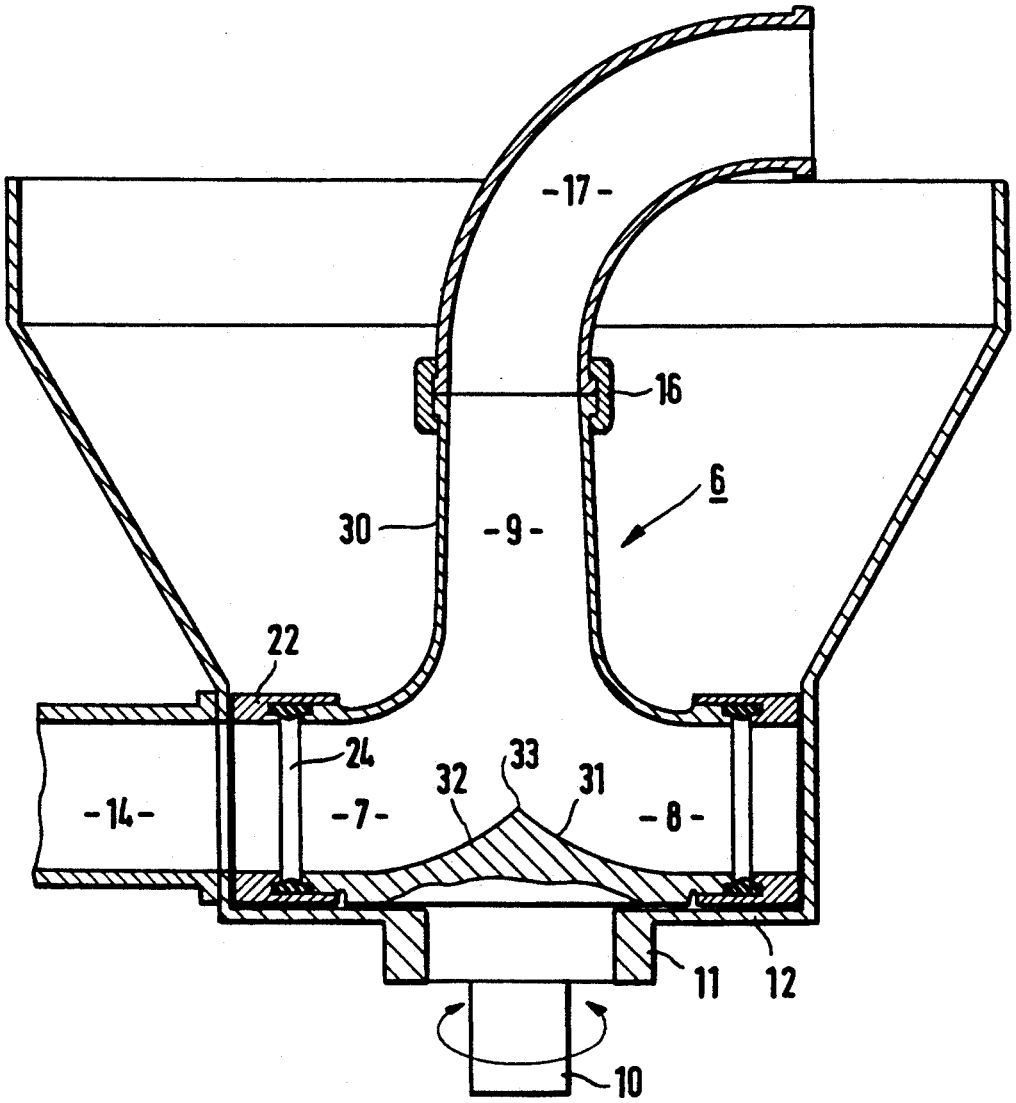
FIG. 1, in vertical section, a first embodiment form of the invention, with all details omitted, which are not essential for an understanding of the invention.
Figure 3:
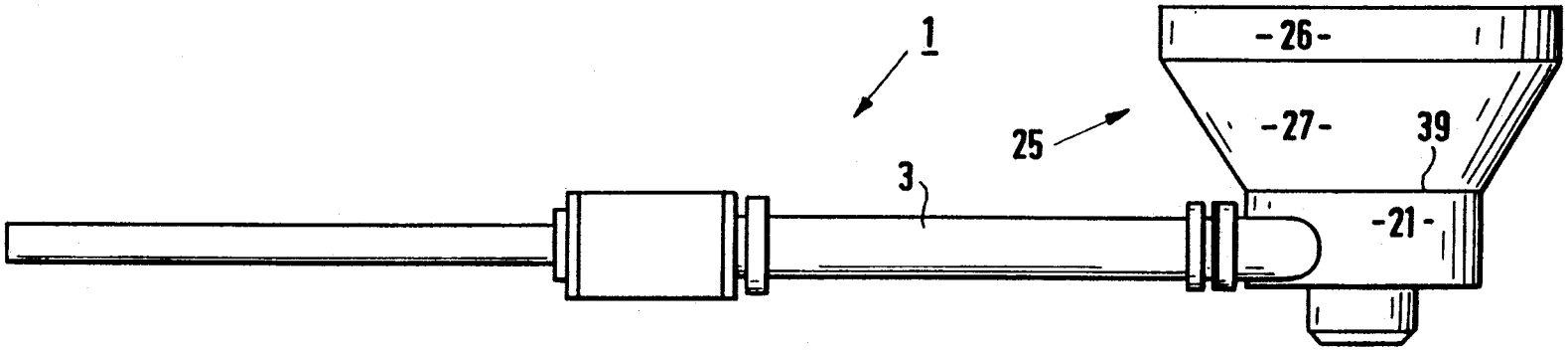
FIG. 3, a side view of a thick materials pump in keeping with the invention and in keeping with the embodiment form shown in FIGS. 1 and 2.
Figure 4:
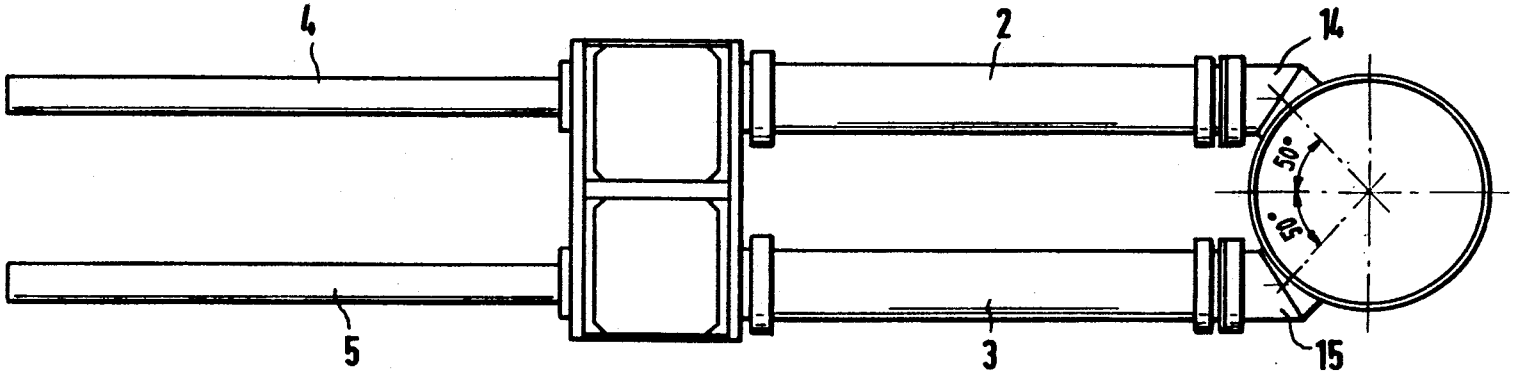
FIG. 4, a top view of the embodiment shown in FIG. 3.

As illustrated in FIGS. 3 and 4, the thick materials pump (1) is designed as a two-cylinder piston pump. They correspondingly provide two parallel feed cylinders (2, 3), which alternatingly deliver and intake. The unillustrated pistons of the feed cylinders (2, 3) are operated in push-pull fashion by similarly unillustrated pistons in hydraulic drive cylinders (4, 5). When the pump (1) is in operation, a slide (6) (FIG. 1) executes pivoting movements and always has one branch channel and a central channel (9). The pivotal movement takes place on the geometrical axis of the central channel (9) with the help of a shaft (10), which is axially mounted in a radial ball bearing (11) and passes through the base (12) of the slide housing. In the end positions of the pivotal movement of the slide (6), one of the branch channels (7, 8), in the embodiment example in FIG. 1, the branch channel (7), is always aligned with the cylinder (2) one of the two elbows (14, 15), i.e., in the embodiment example, by the elbow (14), whereby the connection to the central channel (9) is formed. By means of a concentric, monocoque coupling (16), the central channel is rotatably aligned with the end, designed as an elbow (17), of a not-further-illustrated feed conduit.

In this position of the slide (6), the second branch channel (8), while freeing the intake feed cylinder, i.e., the opening of the elbow (15), is simultaneously closed against a sealing control surface (18). The latter, together with a second sealing control surface (20), is situated on the interior wall (19) of a slide housing (21). In the embodiment example, the seal is provided by an axially displaceable pipe ring (22), which, with its curved front (33), is metallically adjoined with the cylindrical surface (20) on the interior wall of the housing, while the inner end of the pipe ring is borne on the outside of the branch channel (7) and forms an enclosed seal (24), which is practically impervious on four sides with the exception of an inwardly oriented partial area.

The thick material to be conveyed flows to the slide housing (21) through a filling container (25), which has a cylindrical riser (26) and a conical feed hopper (27), the retracted end of which is aligned with the upper end of the cylindrical slide housing (21).

In keeping with the portrayed manner of operation of the illustrated thick materials pump, the housing has two apertures (28, 29). The particular aperture (28 or 29) freed for one or the other branch channel (7, 8) permits the thick material to flow from the filling container (25) through the slide housing and into the intake cylinder (3 or 2). The free openings of the branch channels (7, 8), i.e., of the pipe slide (22), are identical. Furthermore, the branch channels (7, 8) are identical in length.

In the embodiment example illustrated in FIGS. 1–4, these branch channels (7, 8) are exactly aligned. In each case, they form an exact right angle with the central channel, so that a T-form results, in which the straight, transverse line is formed by the two channels (7, 8), and this transverse line joins at a right angle with the long line (30), which encompasses the central channel, to produce the T-form in the plane of the transverse line. In order to achieve a form of the converging channels (7–9) which favors flow, the tubular surfaces (31, 32) of the branch channels (7, 8) are designed to converge (33), which takes place at the central axis of the long line (30).

Figure 5:
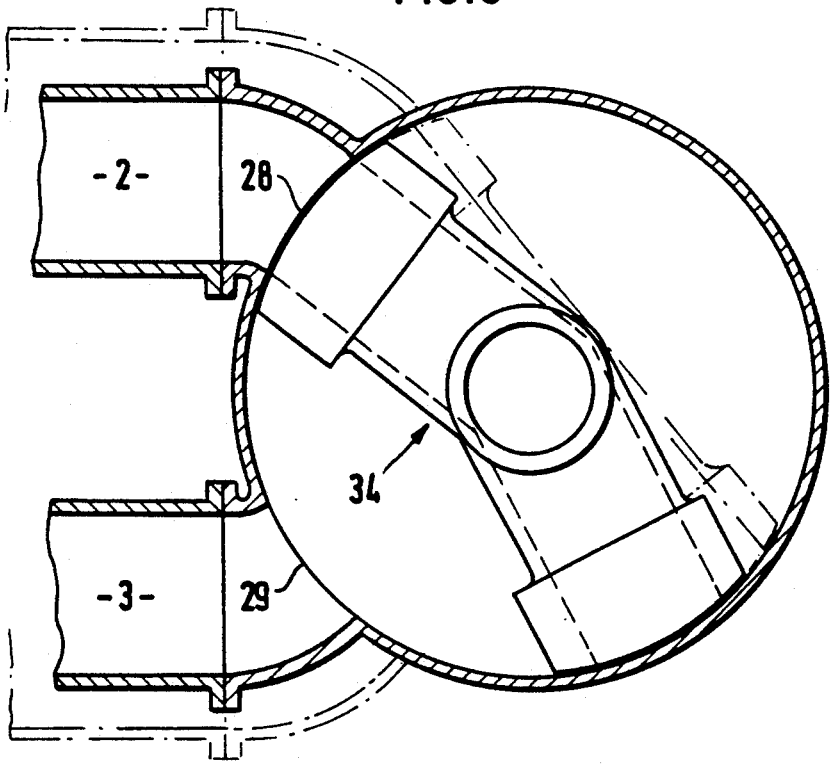
FIG. 5, schematic and essentially in the presentation in FIG. 2, a modified embodiment form of the invention.

The embodiment form depicted in FIG. 5 differs therefrom by a transverse line (34), which runs at an acute angle from the plane of the T-form to one side, as a result of which the housing apertures (28, 29) are closer together and the separation of the parallel feed cylinders (2, 3) is correspondingly less.

Figure 6:
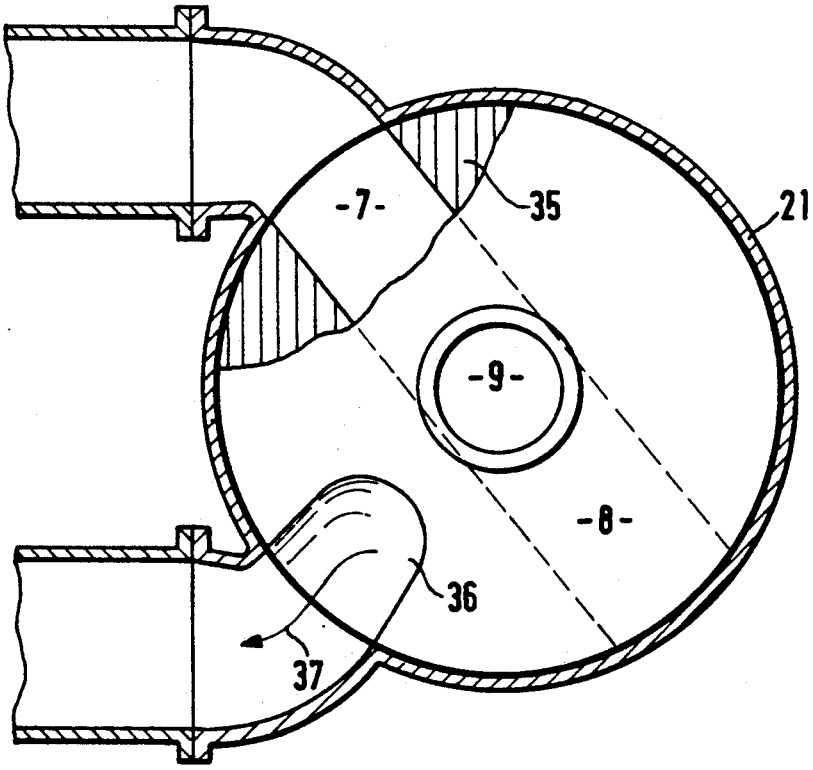
FIG. 6, in the same presentation as in FIG. 5, a further modified embodiment form of the invention.

While the form of the slide in the embodiment forms depicted in FIGS. 1–5 is tubular, such is not the case in the embodiment form shown in FIG. 6. Here the slide takes the form of a full cylinder (35), in which the transverse channels (7, 8), as well as at least that part of the central channel (9) joined to the transverse line, are recessed. This full cylinder rides in the cylindrical housing (21) with rotary play. It is centrally penetrated, as may be seen in FIG. 6, by the recesses for the channels (7–9). In addition, it has a peripheral recess (36) along the cylindrical wall (21), which serves as an intake path, is identified by an arrow (37), and makes it possible that the intake cylinder can be filled with thick material from the filling container (25).

In all of the embodiment examples, the slide housing (21) is designed as a hollow cylinder, the axis of which coincides with the axis of the central channel (9), and the cylinder wall (21) has the described apertures (28, 29) for the feed cylinders (2, 3) to the sealing control surfaces (18, 20) of the branch channels (7, 8), while an upper aperture (39) (FIG. 3) aligns with the opening of the filling container (21). The opposing aperture is closed except for the passageway for the shaft.

Figure 2:
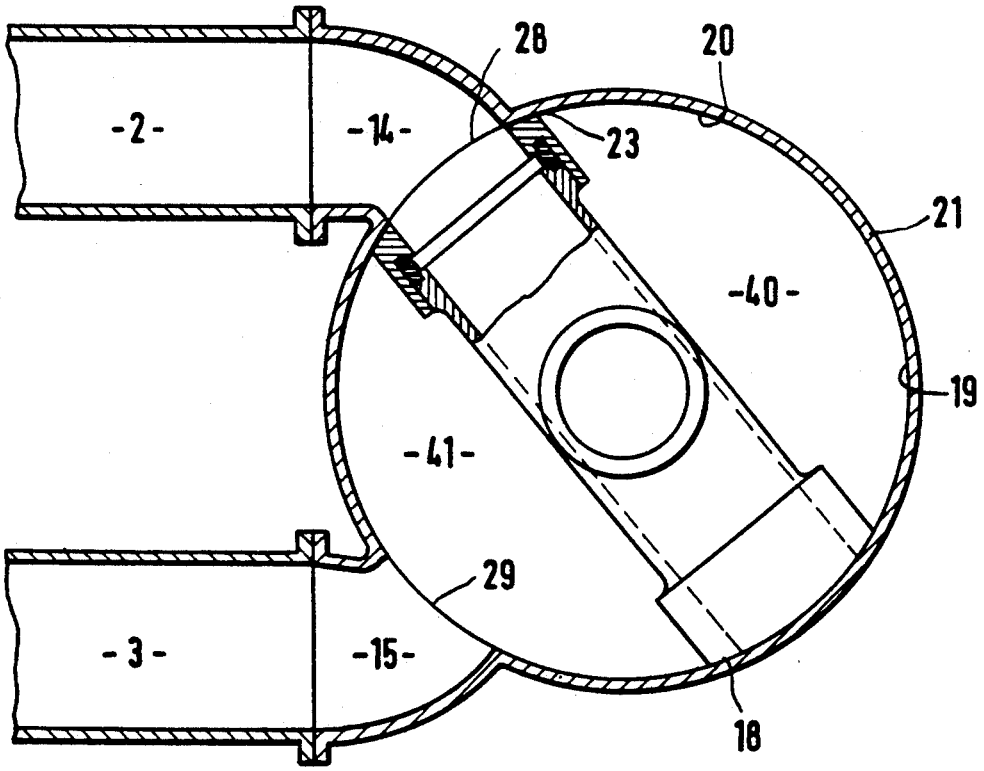
FIG. 2, a top view of the embodiment shown in FIG. 1.

As depicted in FIG. 2 and as a result of the described form, identical spaces (40, 41) are formed at both sides of the tubular slide. The pivotal movement of the slide covers approximately 50 degrees to each side (FIG. 4). In the spaces (40, 41), the material advanced from the leading branch channel is always equal to the material being fed into the spaces (40, 41) from the trailing branch channel. As a result, there is no drop in pressure in the thick material passing through the cylinder housing.

What is claimed is:

1. Thick materials pump with multiple feed cylinders, which alternatingly deliver and intake, and with a slide pivotally supported, the slide including multiple branch channels and a central channel coupled with a feed conduit for discharge of material pump from a selected feed cylinder, the slide being pivotal about the axis of the central channel for alternatingly connecting one of the branch channels with a corresponding feed cylinder the improvement wherein:

the slide is operable within a cylindrically shaped slide housing and where the branch channels are in opposed relation and extend perpendicularly from the central channel and pivot axis of the slide to selectively couple with a corresponding feed cylinder for operation, the branch channels being sealed by sealing control surfaces defined by a cylindrically shaped wall of the slide housing.

2. Thick materials pump according to claim 1, characterized by the fact that the branch channel (7, 8) form a transverse line, which joins with the central channel (9) to form a T-shape.

3. Thick materials pump according to claim 1, characterized by the fact that the slide housing (21) takes the form of a hollow cylinder, the axis of which coincides with the axis of the central channel (9) and its cylinder wall (19) is provided with the apertures (28, 29) for the feed cylinders (2, 3) and, on the inside, the sealing control surfaces (18, 20) for the branch channels (7, 8), while an upper aperture (39) of the hollow cylinder opens in to a filling container (25) and the opposing aperture of the slide housing (21) is closed.

4. Thick materials pump according to claim 1, characterized by the fact that the slide (6) is designed as a full cylinder, which rides with rotary play on the cylinder wall (19) of the slide housing (21) and has central recesses for the branch channels (7, 8) and the central channel (9), as well as a peripheral recess (36) along the cylindrical wall (19) of the slide housing (21), which serves as an intake path.

5. Thick materials pump with multiple feed cylinders which alternatingly deliver and intake, and with a slide pivotally supported within a slide housing, the slide including multiple branch channels and a central channel coupled with a feed conduit for discharging material pumped from a selected feed cylinders, the slide being pivoted on a pivot axis for alternatingly connecting one of said branch channels with a corresponding feed cylinder for discharge, the improvement wherein:

the branch channels are radially directed and extend from the pivot axis of the slide and are aligned in opposed relation to selectively couple with a corresponding feed cylinder in coaxially alignment with said feed cylinder for pumping operation; and the central channel is fluidly coupled with each of said branch channels and aligned with the pivot axis of the slide for directing material from a selected branch channel for discharge through the feed conduit.

6. The thick materials pump of claim 5 wherein the slide housing is cylindrical and has an axis coinciding with the pivot axis of the slide, the slide housing including apertures for the feed channels for connecting a selected branch channel with a selected feed cylinder and a cylindrical wall of the slide housing defining sealing control surfaces for sealing a selected branch channel during operation.

* * * * *

UNITED STATES PATENT AND TRADEMARK OFFICE

CERTIFICATE OF CORRECTION

PATENT NO. : 5,281,113

DATED : January 25, 1994

INVENTOR(S) : ANDREJ SIMNOVEC

It is certified that error appears in the above-identified patent and that said Letters Patent is hereby corrected as shown below:

On the Title Page, in the [56] References Cited Section, insert:

FOREIGN PATENT DOCUMENTS 1963875 6/1971 Fed. Rep. of Germany.....

1653614 8/1971 Fed. Rep. of Germany.....

2721678 12/1977 Fed. Rep. of Germany.....

On the Title Page, in line 18 (last line) of the [57] ABSTRACT, after "cylindrically arched", insert --(Figure 2)--

Col. 1, line 14, delete "of claim 1.", insert --to claim 1.--

Signed and Sealed this

Sixteenth Day of August, 1994

*Attest:*

Bruce Lehman

BRUCE LEHMAN

*Attesting Officer*

*Commissioner of Patents and Trademarks*